US006135799A

United States Patent [19]

Lincoln

[11] Patent Number: 6,135,799

[45] Date of Patent: Oct. 24, 2000

[54] COUPLING NUT RETENTION APPARATUS

[75] Inventor: Thomas C. Lincoln, Areadia, Calif.

[73] Assignee: UniStar Industries, South Pasadena, Calif.

[21] Appl. No.: 09/286,568

[22] Filed: Apr. 5, 1999

[51] Int. Cl.[7] ..... H01R 4/38

[52] U.S. Cl. ..... 439/320

[58] Field of Search ..... 439/310, 312, 439/314, 320, 321, 322, 323

[56] References Cited

U.S. PATENT DOCUMENTS

| | | | |
|---|---|---|---|
| 2,892,991 | 6/1959 | Beebee et al. | 339/91 |
| 3,639,890 | 2/1972 | Stevens et al. | 339/91 |
| 3,786,396 | 1/1974 | Kemmer et al. | 339/89 |
| 3,808,579 | 4/1974 | Mina et al. | 339/46 |
| 3,964,771 | 6/1976 | Baudouin | 285/315 |
| 4,407,529 | 10/1983 | Holman | 285/82 |
| 4,580,865 | 4/1986 | Fryberger | 339/103 |
| 4,793,821 | 12/1988 | Fowler et al. | 439/321 |
| 4,801,274 | 1/1989 | Royce | 439/322 |
| 5,702,264 | 12/1997 | Endo et al. | 439/346 |
| 5,984,709 | 11/1999 | Zink et al. | 439/348 |

*Primary Examiner*—Steven L. Stephan
*Assistant Examiner*—Thanh-Tam Le
*Attorney, Agent, or Firm*—Lyon, P.C.

[57] ABSTRACT

A coupling nut retention apparatus 10 for an electrical connector comprises a generally cylindrical coupling nut 20 having an aperature 24 therein for telescopically receiving a cylindrical housing 40 and an annular flange 30 depending therefrom. The housing 40 has a hole 50 in the front end 46 thereof for receiving a retaining ball 80. An insulator 60 having a rear annular flange 66 depending therefrom is telescopically received by an aperature 44 in the cylindrical housing 40 and has an axial keyway 74 therein that is engaged by said retaining ball 80. The annular flanges, 30 and 66 respectively, of the coupling nut 20 and the insulator 60 abut the retaining ball 80 to prohibit forward motion of said coupling nut 20.

4 Claims, 1 Drawing Sheet

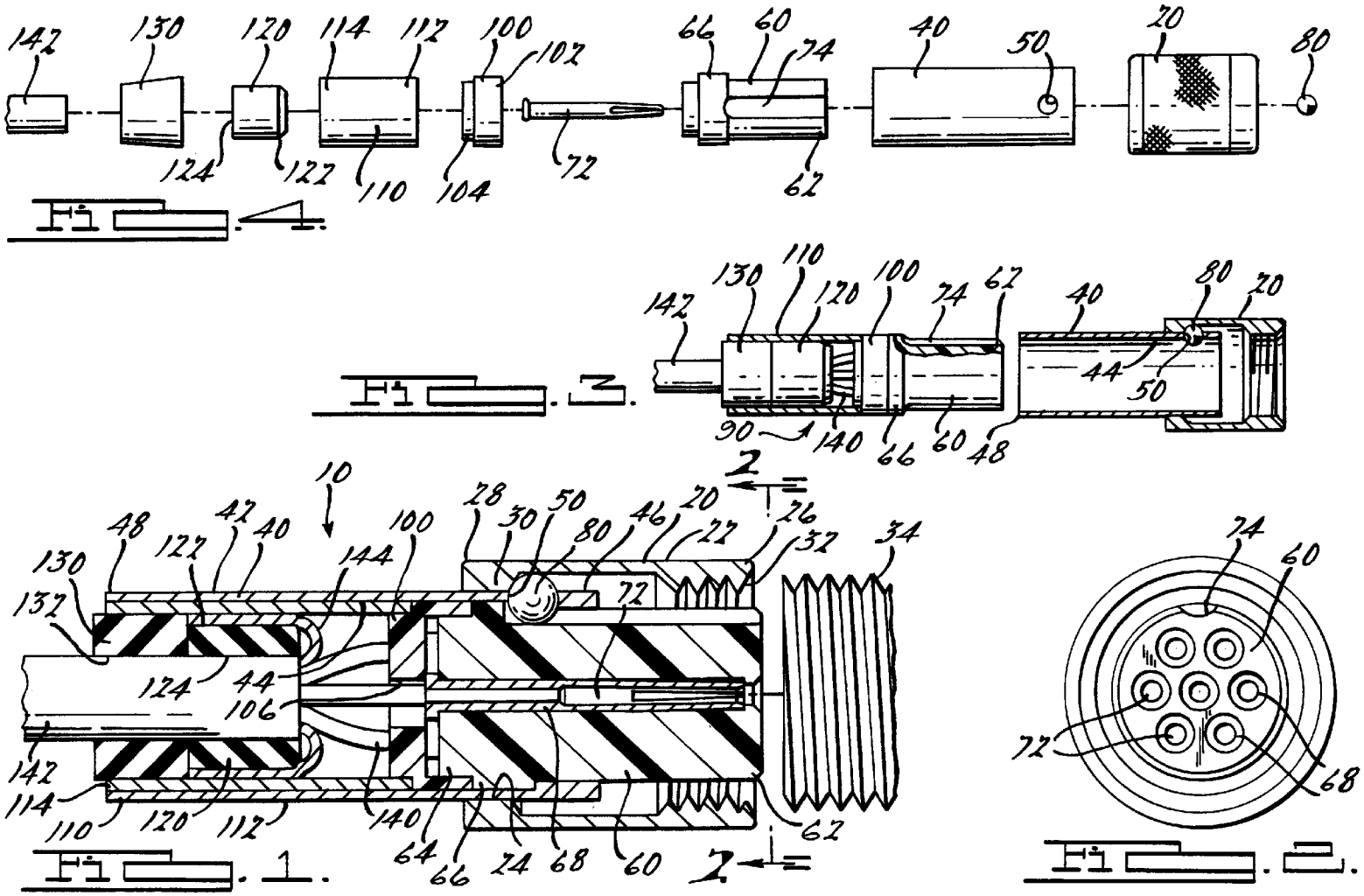

COUPLING NUT RETENTION APPARATUS

BACKGROUND OF THE INVENTION

The instant invention relates generally to a coupling nut assembly for an electrical connector and, more particularly, to a coupling nut retention apparatus comprising a retaining ball cooperating with an aperature in a connector housing to prevent separation of said coupling nut from the assembly.

Connector assemblies used to complete electrical circuits typically comprise a generally cylindrical coupling nut retained on a connector housing. The coupling nut is often provided with a plurality of threads for engaging a corresponding mating connector and is rotatable relative to the housing. Known coupling nuts are telescoped over both the connector housing and an annular flange thereon, and then swaged around said flange to retain the nut on the housing while allowing for rotation thereof. Alternatively, known snap rings cooperate with an annular groove in the coupling nut and a corresponding annular groove in the connector assembly to retain the coupling nut thereon.

Swaging of the coupling nut, however, suffers from several drawbacks. In addition to requiring specialized tooling for installation, the swage on the coupling nut relaxes with repeated coupling and uncoupling of the nut, leading to failure of the material securing the nut, thereby rendering it useless. Snap ring assembly techniques require frequent alignment of snap ring installation tooling to assure proper seating of the snap-ring within the connector assembly. The snap ring further provides an additional part in the connector assembly, increasing both the complexity and the expense thereof.

SUMMARY OF THE INVENTION

The aforementioned problems are solved by the coupling nut retention apparatus of the present invention. A coupling nut having an annular flange at one end thereof telescopes over a generally cylindrical housing having a hole therein proximate its front end. A retaining ball is positioned in the housing hole to engage the annular flange of the coupling nut when the coupling nut is in the far forward position. An insulator having an axially oriented keyway on the periphery thereof is telescopically received in the housing. The keyway engages the retaining ball, thereby holding said ball in the housing hole, between the insulator and the coupling nut. A rear housing assembly operates to secure the insulator and housing in place, once crimped.

The instant invention obviates the need for special installation tooling required for known coupling nut retention devices, thereby reducing assembly time and expense, while providing excellent retention strength. Additionally, since the retaining ball "rides" in the insulator keyway, the present invention prevents rotation of the insulator relative to the housing, thereby minimizing mechanical stress on the electrical connections therein when coupling and uncoupling the mating connectors.

Therefore one object of the instant invention is a coupling nut retention device that obviates the need for swaging a coupling nut as a means for retaining same.

A further object of the instant invention is a coupling nut retention device that obviates the need for snap-ring installation and its associated assembly tooling.

A yet further object of the invention is a coupling nut retention device having a retaining ball in communication with an insulator keyway that prohibits rotational motion of the insulator relative to the housing, thereby providing for a robust electrical connection.

Additional objects, features, and advantages of the present invention will become apparent from the subsequent detailed description, taken in conjunction with the accompanying drawing figures.

BRIEF DESCRIPTION OF THE DRAWINGS

FIG. 1 is a cross-section through the assembly of the instant invention.

FIG. 2 is a view of the instant invention taken along the line 2—2 of FIG. 1.

FIG. 3 is a fragmentary cross-section of the instant invention.

FIG. 4 is a fragmentary exploded view of the instant invention.

DETAILED DESCRIPTION OF THE PREFERRED EMBODIMENT(S)

Referring to drawing FIG. 1, and in accordance with the preferred embodiment of the instant invention, a coupling nut retention apparatus 10 comprises a generally cylindrical coupling nut 20 formed of a suitable material, such as steel or plated brass, having an outer periphery 22 and an inner aperature 24 that is coaxial with the periphery 22. The coupling nut 20 further has a front end 26 and a rear end 28, including an annular flange 30 extending radially inwardly therefrom. The front end 26 of the coupling nut 20 may include conventional ramp-type screw threads 32 extending radially inwardly, for engaging a complementary threads of a mating connector 34.

A generally cylindrical housing 40 formed of a suitable material, such as steel or plated brass, has an outer periphery 42 and an aperature 44 therethrough coaxial with the periphery 42. The housing 40 further has a front end 46 and a rear end 48, and a hole 50 therein proximate the front end 46 thereof, for purposes explained hereinbelow. The radius of the generally cylindrical housing 40 is such that the outer periphery 42 thereof is telescopically received by the aperature 24 of the coupling nut 20.

An insulator 60 having a generally cylindrical shape and a radius nominally smaller than the radius of the aperature 44 of said housing 40 is formed from an electrically non-conductive material. The insulator 60 has a front end 62 and a rear end 64 having a radially outwardly extending annular lip 66 thereon. The insulator 60 has a plurality of axially oriented aperatures 68 therein for acceptance of a plurality of electrical sockets 72 or pins (not shown). The electrical sockets 72 are shaped to be engaged by complementary pins, as is well known to one of ordinary skill in the art. Many known in the art connector assemblies employ a plurality of pins and/or sockets to connect multiple circuits within the same connector.

As best seen in FIGS. 2 & 4, the insulator 60 has an axially oriented keyway 74 therein, extending on the periphery from the front end 62 thereof to the annular lip 66. The keyway 74 is shaped to allow a retaining ball 80 to be seated therein, and to rotate relative thereto as the insulator 60 is axially displaced.

Assembly of the coupling nut retention apparatus is effected by inserting the front end 46 of the housing 40 into the aperature 24 of the coupling nut 20 until the annular flange 30 thereof is rearward of the housing hole 50. As shown in FIG. 3, the retaining ball 80 is inserted from the housing aperature 44 into the hole 50. The front end 62 of the insulator 60 is telescopically received by the housing aperature 44 at the rear end 48 thereof, oriented so that the keyway 74 is aligned with the retaining ball 80. The insulator 60 slides axially forward towards the front end 46 of the housing 40 until the annular lip 66 thereof contacts the retaining ball 80 thereby preventing the insulator 60 from further forward movement. The rear end 48 of the housing 40 is then crimped over a rear sleeve assembly 90 using known in the art crimping techniques to complete the assembly.

While the rear sleeve assembly 90 may be one of many known in the art connector sleeve configurations, for purposes of the instant invention the rear sleeve assembly 90 comprises a rear insulator 100, a crimp sleeve 110, an inner sleeve 120 and a sealing sleeve 130. As best seen in FIGS. 1 & 4, the Tear insulator 100 is comprised of a forward annular section 102 and a rear annular section 104. The rear annular section 104 has a smaller radius than the front annular section 102. The rear insulator 100 further has a plurality of axially oriented aperatures 106 therein, that extend through both the forward 102 and rear 104 annular sections thereof, for acceptance of a plurality of conductors 140 in a multi-conductor cable 142.

The crimping sleeve 110 is a right circular cylinder having a periphery 112 and an aperature 114 that is coaxial with the periphery 112 sized to telescopically engage the rear annular section 104 of the rear insulator 100. The crimping sleeve 110 is preferably constructed from a semi-rigid deformable material, such as brass or bronze, that retains its shape when crimped.

The inner sleeve 120 is generally cylindrical and formed of a suitable material, for example a rubber compound, and has an outer periphery 122 and an aperature 124 coaxial with the periphery 122.

The sealing sleeve 130 has a truncated conical shape and an aperature 132 therein concentric with its central axis for acceptance of the multi-conductor cable 142. Additionally, the sealing sleeve 130 is constructed of a suitable compressible, flexible material to allow for deformation when the crimping sleeve 110 is compressed.

To assemble the rear sleeve assembly 90, the plurality of conductors 140 of the multi-conductor cable 142 are inserted sequentially through the aperature 132 of the sealing sleeve 130, through the aperature 124 of the inner sleeve 120, through the aperature 114 of the crimping sleeve 110, and finally through the plurality of aperatures 106 in the rear insulator 100. A plurality of sockets 72 (or pins) are then crimped or soldered to the plurality of conductors 140. The sockets 72 are then inserted in the plurality of aperatures 68 of the insulator 60.

The crimping sleeve 110 is telescoped over the annular section 104 of the rear insulator 100 until it abuts the forward annular section 102 thereof. The inner sleeve 120 and the sealing sleeve 130 are then inserted into the aperature 114 of the crimping sleeve 110 to complete the assembly. It should be noted that the crimping sleeve 110 is interior of, and concentric with, the housing 40. The crimping sleeve 110 and the housing 40 are then compressed around the flexible, compressible sealing sleeve 130 using a known-in-the-art crimping tool, thereby preventing the rear sleeve assembly 90 from separating from the housing 40. Since the crimping sleeve 110 abuts the annular lip 102 of the rear insulator 100, and the rear insulator 100 abuts the annular lip 66 of the insulator 60, the insulator 60 cannot move rearwardly, thereby capturing the retaining ball 80 in the housing hole 50.

It should be noted that when the multi-conductor cable 142 is provided with a shield 144 for purposes of grounding unwanted noise, the shield may be folded back over the periphery of the inner sleeve 120. When the connector is assembled, the shield 144 is forced into close proximity with the crimping sleeve 110, thereby providing a path through the metallic components of the connector assembly to the shield of a mating cable.

While the preferred embodiment of the instant invention is disclosed in detail, it will be appreciated by one of ordinary skill in the art that the instant invention is susceptible to various modifications without departing from the scope of the following claims.

What is claimed is:

1. A coupling nut retention apparatus for a connector having a deformable crimping sleeve for accepting a cable, comprising:

a generally cylindrical coupling nut having a periphery, an aperature coaxial with the periphery, a front end, and a rear end having a radially inwardly extending flange depending therefrom;

a generally cylindrical housing having a periphery, an aperature coaxial with the periphery, a front end telescopically received by the aperature of said coupling nut, a rear end, and a hole therein proximate the front end thereof;

a generally cylindrical insulator having a periphery telescopically received by the aperature of said housing having an axial keyway therein, a plurality of axially oriented aperatures therein for acceptance of electrical conductors, a front end, and a rear end having a radially outwardly extending annular flange depending therefrom; and a retaining ball positioned in the hole of said housing wherein said insulator keyway is engaged by said retaining ball, and the flange of said coupling nut and the flange of said insulator abut said retaining ball.

2. The coupling nut retention apparatus as claimed in claim 1 wherein the deformable crimping sleeve is telescopically received in the aperature of said housing and crimped proximate the second end thereof.

3. The coupling nut retention apparatus of claim 1 wherein said coupling nut has a plurality of ramp type screw threads extending radially inwardly from the front end thereof for engaging complementary threads of a mating connector.

4. The coupling nut retention apparatus of claim 2 wherein said coupling nut has a plurality of ramp type screw threads extending radially inwardly from the front end thereof for engaging complementary threads of a mating connector.

* * * * *